US009044650B2

(12) United States Patent
Kuntimaddi

(10) Patent No.: US 9,044,650 B2
(45) Date of Patent: Jun. 2, 2015

(54) SYSTEM AND METHOD FOR PAINTING GOLF BALLS

(75) Inventor: Manjari Kuntimaddi, Raynham, MA (US)

(73) Assignee: Acushnet Company, Fairhaven, MA (US)

( * ) Notice: Subject to any disclaimer, the term of this patent is extended or adjusted under 35 U.S.C. 154(b) by 300 days.

(21) Appl. No.: 13/597,302

(22) Filed: Aug. 29, 2012

(65) Prior Publication Data

US 2014/0066229 A1 Mar. 6, 2014

(51) Int. Cl.

| | |
|---|---|
| ***A63B 37/14*** | (2006.01) |
| ***A63B 45/02*** | (2006.01) |
| ***A63B 37/00*** | (2006.01) |
| ***B05B 15/04*** | (2006.01) |

(52) U.S. Cl.

CPC ..... *A63B 45/02* (2013.01); *A63B 37/0022* (2013.01); *A63B 37/0074* (2013.01); *B05B 15/045* (2013.01)

(58) Field of Classification Search

USPC ..... 473/378–385

See application file for complete search history.

(56) References Cited

U.S. PATENT DOCUMENTS

| | | | | | |
|---|---|---|---|---|---|
| 676,506 | A | * | 6/1901 | Knight et al. | 473/268 |
| 2,561,947 | A | * | 7/1951 | Premo | 101/41 |
| 3,161,041 | A | * | 12/1964 | Amburgey | 73/65.02 |
| 3,647,221 | A | * | 3/1972 | Holley | 473/376 |
| 4,258,921 | A | * | 3/1981 | Worst | 473/268 |
| 4,803,922 | A | * | 2/1989 | Dennesen | 101/41 |
| 5,130,173 | A | | 7/1992 | Barten et al. | |
| 5,248,878 | A | * | 9/1993 | Ihara | 219/121.69 |

(Continued)

FOREIGN PATENT DOCUMENTS

| | | | | | |
|---|---|---|---|---|---|
| JP | 05111550 | A | * | 5/1993 | A63B 45/00 |
| JP | 2002224241 | A | * | 8/2002 | A63B 37/00 |

(Continued)

*Primary Examiner* — Alvin Hunter

(74) *Attorney, Agent, or Firm* — Margaret C. Barker

(57) ABSTRACT

A golf ball painting system and method comprising: providing at least one golf ball, the cover having an outer surface comprising a surface area $S_a$; masking a portion $P_1$ of surface area $S_a$ with at least one masking part $MA_1$, portion $P_1$ having a surface area $S_b$ that is less than surface area $S_a$; applying paint having a color $C_1$ onto an unmasked portion $P_2$ of surface area $S_a$, portion $P_2$ having a surface area $S_c$ that is less than surface area $S_a$ and such that $S_c+S_b+S_n=S_a$ wherein n is the number of masking parts; masking surface area $S_c$ with a masking part $MA_2$; removing $MA_1$ from $S_b$; painting $S_b$ a color $C_2$ wherein $C_2$ is different than $C_1$; forming a painted golf ball having an overall color appearance of at least two different colors.

24 Claims, 9 Drawing Sheets

(56) References Cited

U.S. PATENT DOCUMENTS

| | | | | |
|---|---|---|---|---|
| 5,427,378 | A * | 6/1995 | Murphy | 473/353 |
| 5,662,530 | A * | 9/1997 | Sellar | 473/268 |
| 6,004,223 | A * | 12/1999 | Newcomb | 473/257 |
| 6,453,807 | B1 * | 9/2002 | Ramey | 101/35 |
| 6,676,544 | B2 * | 1/2004 | Tyke | 473/406 |
| 6,716,112 | B2 * | 4/2004 | Rennecamp | 473/257 |
| 6,752,725 | B2 * | 6/2004 | Kim | 473/280 |
| 7,063,747 | B2 | 6/2006 | Lastowka | |
| D525,300 | S * | 7/2006 | Helmstetter | D19/40 |
| 7,520,218 | B2 * | 4/2009 | Tebbe | 101/128 |
| D604,786 | S * | 11/2009 | Millar | D21/789 |
| 7,765,931 | B2 * | 8/2010 | Kennedy et al. | 101/491 |
| 8,008,641 | B2 | 8/2011 | Harris et al. | |
| 8,308,587 | B1 * | 11/2012 | Morgan | 473/378 |
| 8,403,768 | B2 * | 3/2013 | Aittola | 473/280 |
| 8,491,418 | B2 * | 7/2013 | Morgan | 473/378 |
| 8,627,768 | B2 * | 1/2014 | Smith | 101/35 |
| 2010/0151971 | A1 | 6/2010 | Mydlack et al. | |

FOREIGN PATENT DOCUMENTS

| | | | |
|---|---|---|---|
| JP | 2008035951 | A * | 2/2008 |
| JP | 2008259721 | A * | 10/2008 |
| JP | 2012115503 | A * | 6/2012 |

* cited by examiner

SYSTEM AND METHOD FOR PAINTING GOLF BALLS

FIELD OF THE INVENTION

Systems and methods for automatically painting/coating multiple colors onto a golf ball outer surface.

BACKGROUND OF THE INVENTION

Conventional golf balls generally comprise a core surrounded by a cover and optionally intermediate layers there between. The cover forms a spherical outer surface and typically includes a plurality of dimples. The core and/or the cover may incorporate multiple layers and the core may be solid or have a fluid-filled center surrounded by windings and/or molded material. Golf ball covers may be formed from a variety of materials such as balata, polyurethane, polyurea, and/or thermoplastic compositions and ionomer resins such as SURLYN® and IOTEK®, depending upon the desired performance characteristics of the golf ball and desired properties of the cover.

Golf balls are conventionally white, but may also be manufactured with essentially any desired solid color. The solid color may be incorporated in the cover material itself or be applied to the cover outer surface as a coating. Typically, in a painted golf ball, a first coat or primer layer of paint is applied, followed by a second, i.e., finishing coat or layer.

A visually appealing golf ball may boost confidence, which could translate directly into better performance. Accordingly, golfers have enjoyed distinguishing themselves on the green by playing a golf ball having a unique visual appearance. In this regard, golf balls have been customized manually using permanent marker to ink multiple colors onto a golf ball surface. Additionally, printing and stamping methods/systems also exist for applying localized multi-color indicia/markings such as a trademark, logo, design, identification number, model name and/or number onto a golf ball surface. In such systems, ink is applied to a prefab printing plate or stamp which is then applied onto a limited portion of the golf ball surface. More recently, digital images have even been created and uploaded into a program, golf balls loaded into a printer, and then the prefab multi-color digital image applied to a localized portion of the golf ball surface. However, such methods are designed for limited and localized application.

Automated systems for painting/coating a single color onto a golf ball outer surface are known but are not suitable for painting multiple colors onto a golf ball outer surface. In one painting/coating method/system, a light source for each spray gun illuminates a spray location on the golf ball surface to be painted and each coating gun paints the same color onto its respective illuminated spray location. In this system, a tracking device locates the actual golf ball position and an adjuster synchronizes the spray location with the golf ball position to improve accuracy in the painting process. But such systems cannot be utilized to apply more than one color to the golf ball outer surface because these devices lack any way of preventing paint from undesirably running, splattering, seeping or otherwise migrating from one discrete color region to another on the golf ball's very limited surface area.

While dual-colored golf balls exist wherein a different color is incorporated directly into first and second half shell cover parts which are formed about the inner layers, many golfers prefer the unique overall golf ball color appearance achieved where color is applied/painted/coated onto the golf ball cover outer surface. Thus, there is a need for an automated system designed to paint/coat a golf ball a plurality of different colors producing golf balls possessing a unique overall cosmetic visual appearance comprising and displaying a predetermined multi-colored pattern. The present invention addresses and solves this need.

SUMMARY OF THE INVENTION

Accordingly, the invention is directed to a golf ball painting system and method for applying and patterning at least two different paint colors onto a golf ball outer surface comprising: providing at least one golf ball to be painted comprising a core and a cover disposed about the core, wherein the cover has an outer surface comprising a surface area $S_a$; masking a portion $P_1$ of surface area $S_a$ with at least one masking part $MA_1$, portion $P_1$ having a surface area $S_b$ that is less than surface area $S_a$; applying paint having a color $C_1$ onto an unmasked portion $P_2$ of surface area $S_a$, portion $P_2$ having a surface area $S_c$ that is less than surface area $S_a$ and such that $S_c+S_b+S_n=S_a$ wherein n is the number of masking parts; masking surface area $S_c$ with a masking part $MA_2$; removing $MA_1$ from $S_b$; painting $S_b$ a color $C_2$ wherein $C_2$ is different than $C_1$; and thereby forming a painted golf ball having an overall color appearance of at least two colors.

In one embodiment, $C_1$ is opaque. In another embodiment, $C_1$ is translucent. In one embodiment, C2 is opaque. In another embodiment, C2 is translucent.

In one embodiment, $S_b<S_c$. In another embodiment, $S_b>S_c$. In one embodiment, each of the $S_n$ masking surface areas are different. In another embodiment at least two of $S_n$ masking surface areas are substantially similar. In yet another embodiment, at least two of masking surface areas $S_n$ are substantially similar.

In one embodiment, $S_b\geq0.75\times(S_a)$. In another embodiment, $S_b\geq0.50\times(S_a)$. In yet another embodiment, $S_b\geq0.25\times(S_a)$. In still another embodiment, $S_b\geq0.33\times(S_a)$. In an alternative embodiment, $S_b\geq0.10\times(S_a)$. In a different embodiment, $S_b$ is up to about $0.10\times(S_a)$.

In one embodiment, $S_c=0.95\times(S_b)$. In another embodiment, $S_c=0.75\times(S_b)$. In yet another embodiment, $S_c=0.50\times(S_b)$. In still another embodiment, $S_c=0.25\times(S_b)$. In a different embodiment, $S_c=0.33\times(S_b)$.

Masking part $MA_1$ has a surface area that is greater than surface area $S_b$. Masking part $MA_2$ has a surface area that is substantially greater than surface area $S_c$. Masking parts $MA_n$ each have a surface area that is greater than to each of $S_n$.

In another embodiment, the golf ball painting system and method for applying and patterning at least two different paint colors onto a golf ball outer surface comprises: placing a multitude golf balls to be painted on an endless conveyer, each golf ball comprising a core and a cover disposed about the core, wherein the cover has an outer surface comprising a surface area $S_a$ and having an opaque or translucent color $C_1$; masking a portion $P_1$ of surface area $S_a$ with masking part $MP_1$, portion $P_1$ having a surface area $S_b$ that is less than surface area $S_a$; applying paint having color $C_2$ onto the outer surface wherein $C_2$ is different than $C_1$ and forming an unmasked painted portion $P_2$ having golf ball surface area $S_c$ wherein $S_a=S_b+S_c$; and removing masking part $MP_1$ from portion $P_1$ thereby forming a painted golf ball having an overall color appearance such that:

(i) $S_b$ has the color appearance of $C_1$; and (ii) $S_c$ has the color appearance of $C_2$ where $C_2$ is opaque; or (iii) $S_c$ has the color appearance $C_3$ where $C_2$ is translucent, wherein $C_3$ is different than $C_1$ and $C_2$.

In yet another embodiment, the golf ball painting system and method for applying and patterning at least two different paint colors onto a golf ball outer surface comprises:

(a) placing a multitude golf balls to be painted on an endless conveyer, each golf ball comprising a core, and a cover disposed about the core, the cover having an outer surface comprising a surface area $S_a$ and being an opaque or translucent color $C_1$;

(b) masking a portion $P_1$ of surface area $S_a$ with masking part $MA_1$ portion $P_1$ having a surface area $S_b$ that is less than surface area $S_a$;

(c) applying paint having color $C_2$ onto the outer surface wherein $C_2$ is different than $C_1$ and forming an unmasked painted portion $P_2$ having golf ball surface area $S_c$ wherein $S_a=S_b+S_c$;

(d) removing masking part $MA_1$ from portion $P_1$; and (e) repeating steps (a)-(d) using different masking parts $MA_t$ and different colors $C_t$ wherein t>1 and t represents the number of times steps (a)-(d) are repeated in order to form a golf ball having an overall visual appearance of a predetermined pattern having at least two different colors.

A golf ball painting system and method for applying and patterning at least two different paint colors onto a golf ball outer surface may also comprise: placing a multitude golf balls to be painted on an endless conveyer, each golf ball comprising a core and a cover disposed about the core, wherein the cover has an outer surface comprising a surface area $S_a$ and being pre-painted an opaque or translucent color $C_1$; masking a portion $P_1$ of surface area $S_a$ with masking part MP, portion $P_1$ having a surface area $S_b$ that is less than surface area $S_a$; applying paint having color $C_2$ onto the outer surface wherein $C_2$ is different than $C_1$ and forming an unmasked painted portion $P_2$ having golf ball surface area $S_c$ wherein $S_a$, $S_b+S_c$; and removing the masking part from about portion $P_1$ and forming a painted golf ball having an overall color appearance such that:

(i) $S_b$ has the color appearance of $C_1$; and either (ii) $S_c$ has the color appearance of $C_2$ where $C_2$ is opaque; or (iii) $S_c$ has the color appearance $C_3$ where $C_2$ is translucent, wherein $C_3$ is different than $C_1$ and $C_2$.

In a different embodiment, a golf ball painting system and method for applying and patterning at least two different paint colors onto a golf ball outer surface comprises:

(a) placing a multitude golf balls to be painted on an endless conveyer, each golf ball comprising a core, and a cover disposed about the core, the cover having an outer surface comprising a surface area $S_a$ and being a color $C_1$;

(b) masking a portion $P_1$ of surface area $S_a$ with masking part $MA_1$, portion $P_1$ having a surface area $S_b$ that is less than surface area $S_a$; said masking part $MA_1$ having n non-masking cut-outs that are arranged in a predetermined pattern, wherein n≥1;

(c) applying paint having color $C_2$ onto the outer surface wherein $C_2$ is different than $C_1$ and forming an unmasked painted portion $P_2$ having golf ball surface area $S_c$ wherein $S_a=S_b+S_c$;

(d) removing masking part $MA_1$ from about portion $P_1$; and (e) repeating steps (a)-(d) using different masking parts $MA_t$ and different colors $C_t$ wherein t>1 and t represents the number of times steps (a)-(d) are repeated in order to form a golf ball having an overall visual appearance of a predetermined pattern having a plurality of different colors.

Herein, the term "different color" shall refer to two colors which have different hues, chromas and/or saturations or are otherwise visually distinguishable by the human viewing eye. Herein, the terms "painting" and "coating" shall refer to any known method for applying/providing a colorant onto a golf ball outer surface. Herein, "colorant" shall refer to any medium for delivering/coating/painting a golf ball outer surface and comprising the color.

BRIEF DESCRIPTION OF THE DRAWINGS

Non-limiting features of the present invention are disclosed in the accompanying drawings, wherein similar reference characters denote similar elements throughout the several views, and wherein.

DETAILED DESCRIPTION

FIGS. 1, 2, 3A, 3B, and 4-10 demonstrate non-limiting aspects of a golf ball painting system and method of the invention for applying and patterning at least two different colors onto a golf ball outer surface. Herein, like numbers and letters used in each figure represent like elements or parts.

In one embodiment, a golf ball having a multi-colored appearance may be achieved by pre-coating or pre-painting the golf ball's entire outer surface with a first colorant, followed by partial masking of that pre-coated or pre-painted surface and then further coating/painting remaining unmasked outer surface with a second colorant different than the first. The masking step may utilize/implement any masking part which itself masks less than 100% of the golf ball outer surface and masking may be repeated n times wherein n is the number of different colors desired for the overall golf ball color appearance. In one embodiment, the masking parts collectively mask less than the entire surface area of the golf ball outer surface so that at least a portion of the color of the pre-coated or pre-painted surface golf ball surface is visible to the viewer. In another embodiment, the masking parts collectively mask the entire golf ball outer surface. In this embodiment, the color of the pre-coated or pre-painted surface golf ball surface is not visible to the viewer, although it would contribute to the resulting overall color appearance where the colorants being applied over the precoat are translucent. In one embodiment, at least one of the n colors is translucent. In one embodiment, at least one of the n colors is opaque.

Figure 1:
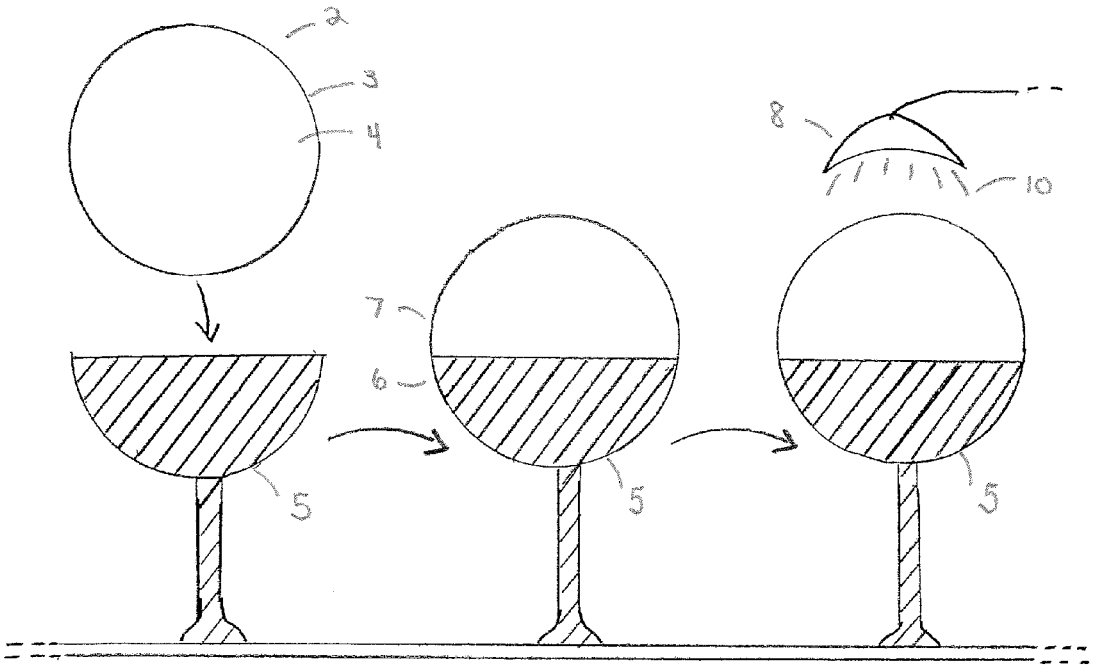
FIG. 1 is a schematic side view depicting one aspect of the golf ball painting system and method for applying and patterning at least two different colors onto a golf ball outer surface.
Figure 2:
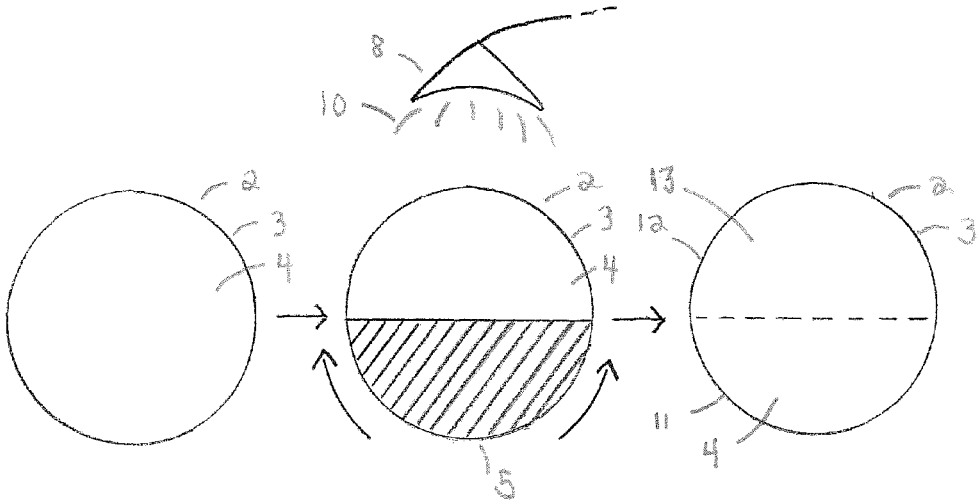
FIG. 2 is a schematic side view depicting another aspect of the golf ball painting system and method for applying and patterning at least two different colors onto a golf ball outer surface.

In FIG. 1, system 1 includes at least one golf ball 2 having outer surface 3. Outer surface 3 is first painted/coated with a colorant having color 4. Then, golf ball 2 is provided or dispensed into masking part 5. Once partially disposed within masking part 5, golf ball 2 has a masked portion 6 and an unmasked portion 7. Paint/colorant applicator 8 applies an opaque paint/colorant having color 10 onto outer surface 3. The resulting golf ball has two colors: portion 11 of golf ball 2, formerly masked portion 6, has color 4, and portion 12 of golf ball 2, formerly unmasked portion 7, has color 10. Where paint/colorant 10 is translucent rather than being opaque, then as seen in FIG. 2, portion 12 of golf ball 2 will appear as color 13, resulting from painting/providing translucent color 10 over color 5.

Figure 7:
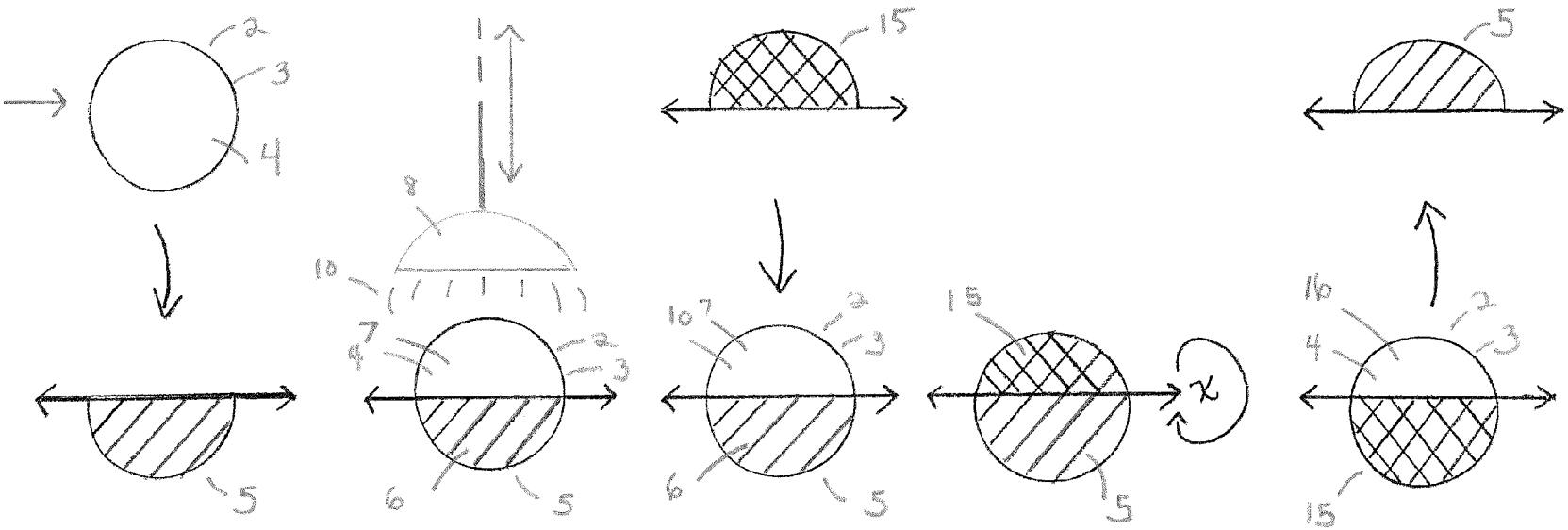
FIG. 7 is a schematic side view depicting still a further aspect of the golf ball painting system and method for applying and patterning at least two different colors onto a golf ball outer surface.

In a different embodiment, a golf ball having a multi-colored appearance may be achieved by providing a first masking part about a first portion of the golf ball outer surface, followed by painting/coating the golf ball outer surface with a first color, then providing a second masking part about a second portion of the golf ball outer surface, followed by removing the first masking part from the first portion, followed by further painting/coating of the golf ball outer surface with a second color different than the first. One example of this embodiment is illustrated in FIG. 7. Removing the masking part from the first portion of the golf ball after providing the second masking part about the second portion of the golf ball prevents unintentional overlapping or running/bleeding of colors onto the golf ball outer surface during paint application.

Accordingly, in FIG. 7, golf ball 2 having outer surface 3 and color 4 is dispensed/provided into masking part 5 such that golf ball 2 has masked portion 6 and unmasked portion 7. Paint/colorant applicator 8 applies opaque paint/colorant 10 onto surface 3 such that unmasked portion 7 has color 10 if paint/colorant 10 is opaque and color 14 if paint/colorant 10 is translucent such that the underlying cover color contributes to the overall color of unmasked portion 7. Masking part 15 is then provided about unmasked portion 7 before masking part 5 is removed from outer surface 3. Golf ball 2 is subsequently rotated 180° about axis x, followed by removing masking part 5 from masked portion 6, which becomes unmasked portion 16. Golf ball 2 is then painted/coated with a different colorant, followed by removing masking part 15, thereby producing a golf ball having an overall color appearance of two colors.

Overlapping colors may be achieved on outer surface 3 of the system/method of FIG. 7 by removing masking part 5 prior to providing masking part 15 about outer surface 3 of golf ball 2. This embodiment is especially useful where at least one colorant is translucent such that overlapping first and second colorants onto the golf ball outer surface may produce a third color different than the first and second colors without having to use a third masking part to accomplish same.

FIG. 7 demonstrates how one of a plurality of golf balls may change as it progresses through each step of the system/method of the invention depicted in FIG. 7. Although one masking part is used in FIG. 7, any number of masking parts may be used simultaneously/collectively and/or sequentially in the embodiment of FIG. 7 as long as the entire golf ball is painted/coated upon completion of the system/method.

Meanwhile, FIG. 2, FIG. 3A, FIG. 3B, FIG. 4, FIG. 5 and FIG. 6 demonstrate how one of a plurality of golf balls may change during the system/method of the invention depicted in FIG. 1. In FIG. 2, a golf ball 2 has an outer surface 3 that initially has one color 4 and is painted/coated with opaque paint/colorant having color 10 so that golf ball 2 becomes a bi-colored golf ball having colors 4 and 10. Alternatively, the paint/colorant having color 10 is translucent rather than opaque, then golf ball 2 becomes a bi-colored golf ball having colors 4 and 13, wherein color 13 is different than colors 4 and 13.

Figure 3A:
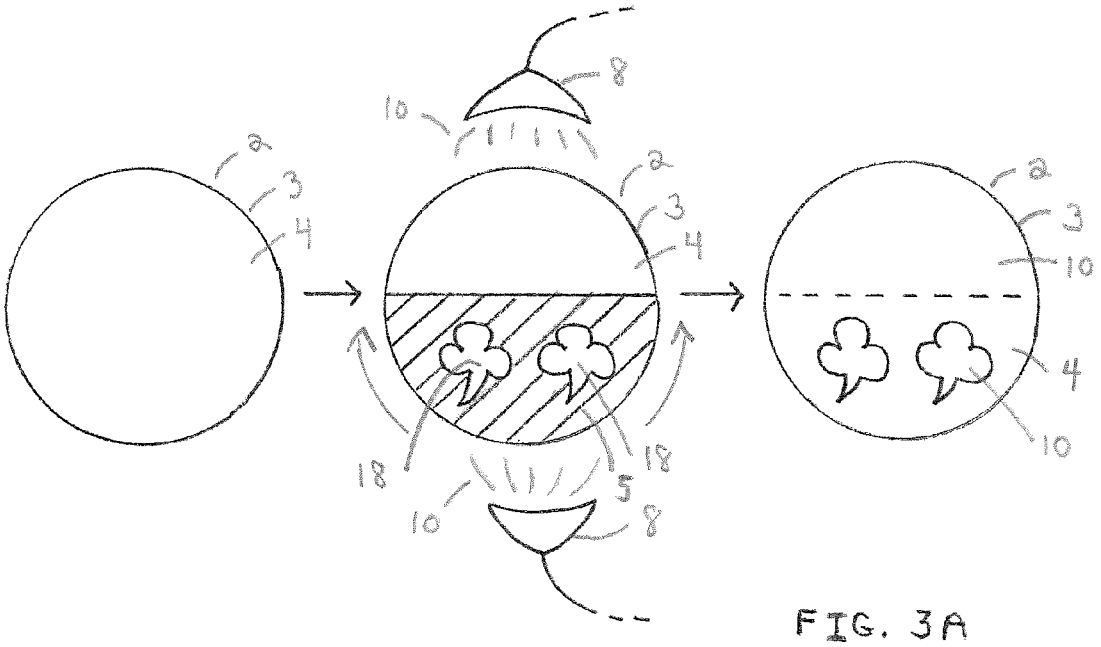
FIG. 3A is a schematic side view depicting yet another aspect of the golf ball painting system and method for applying and patterning at least two different colors onto a golf ball outer surface.
Figure 3B:
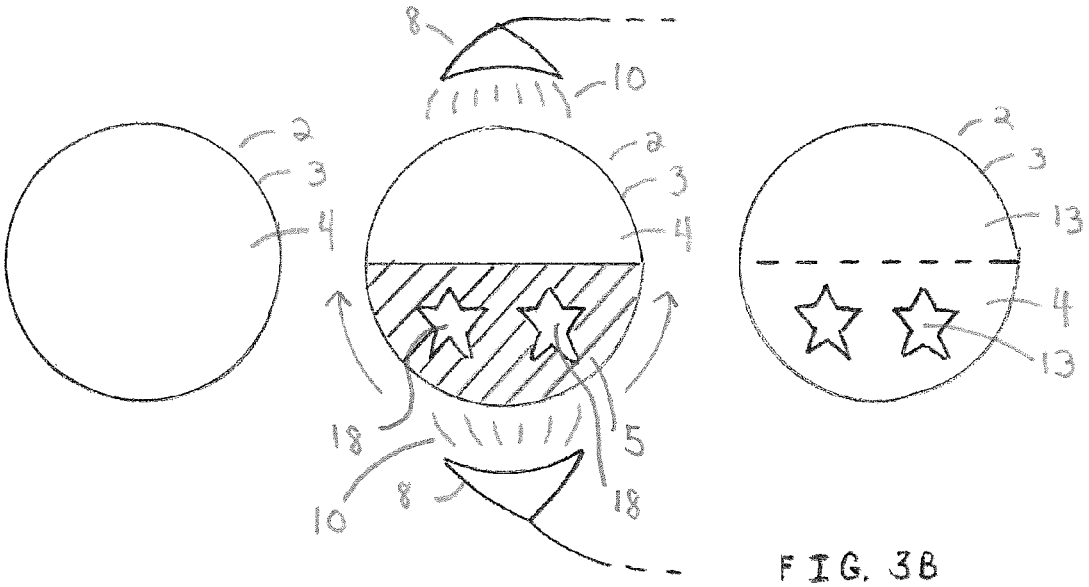
FIG. 3B is a schematic side view depicting still another aspect of the golf ball painting system and method for applying and patterning at least two different colors onto a golf ball outer surface.

FIG. 3A demonstrates an embodiment wherein masking part 5 has designed cut-outs 18 which present/reveal having color 10 when golf ball 2 is painted/coated with opaque paint/colorant having color 10. In FIG. 3B, golf ball 2 is painted/coated with a translucent colorant having color 10 so that the design presents/reveals in painted/coated golf ball 2 as color 13 which is different than colors 4 and 10.

Figure 4:
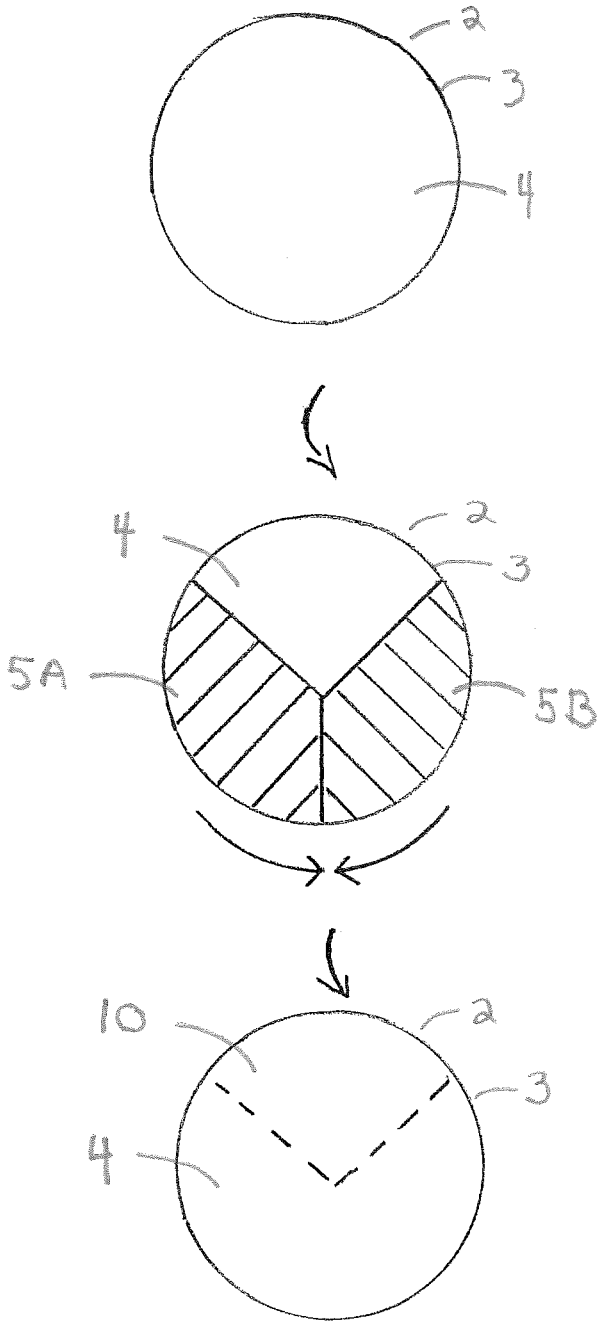
FIG. 4 is a schematic side view depicting a different aspect of the golf ball painting system and method for applying and patterning at least two different colors onto a golf ball outer surface.

In FIG. 4, masking parts 5A and 5B are mated about golf ball 2 having color 4. Outer surface 3 of golf ball 2 is then painted with colorant 10. The resulting golf ball has an overall color appearance of 4 and 10 (13 if colorant 10 is translucent).

Figure 5:
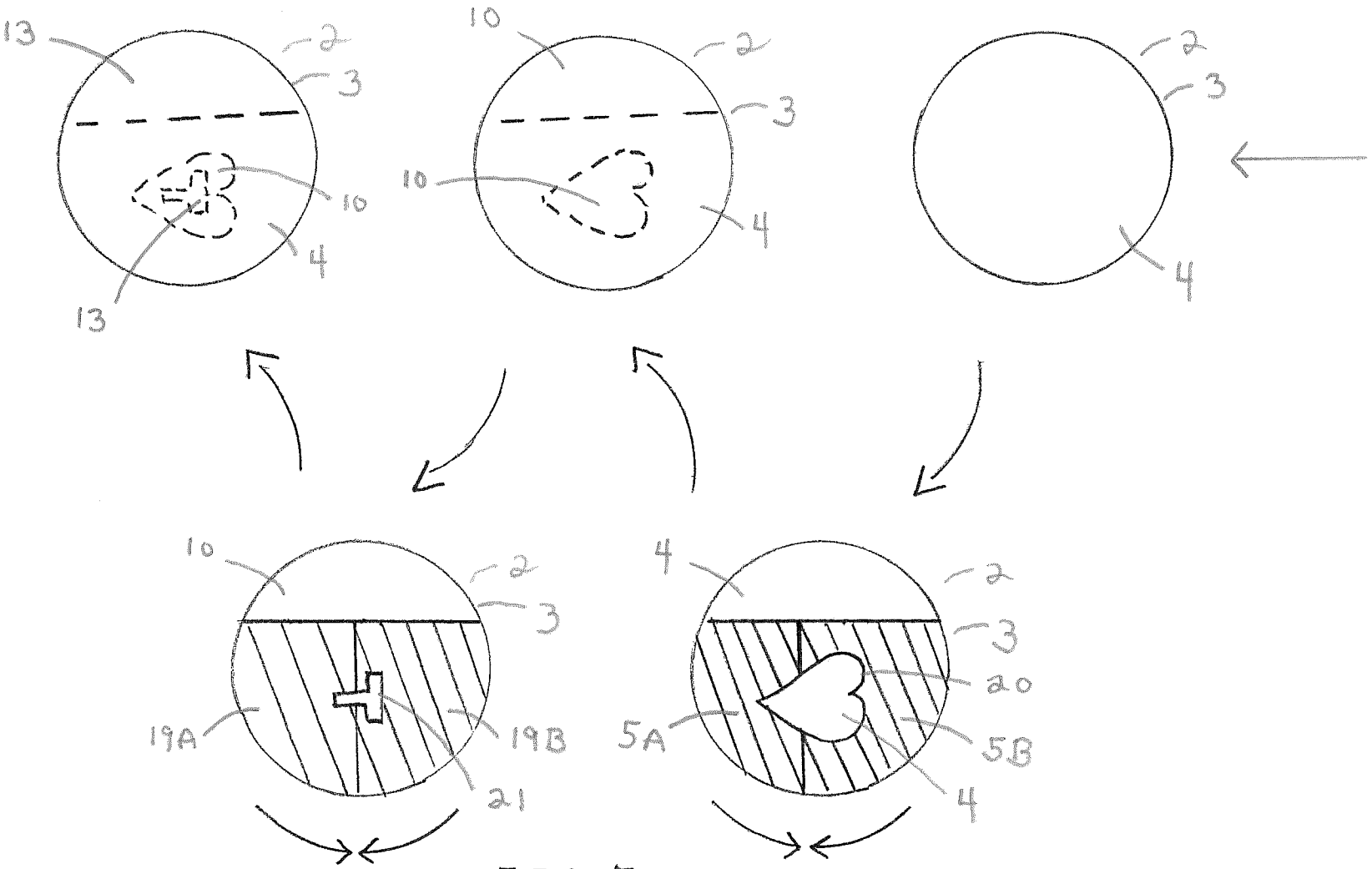
FIG. 5 is a schematic side view depicting an alternative aspect of the golf ball painting system and method for applying and patterning at least two different colors onto a golf ball outer surface.

In FIG. 5, multiple masking parts 5A, 5B having cut-out 20 are mated about golf ball 2 and the golf ball is painted color 10. Multiple masking parts 5A and 5B are then removed, followed by mating masking parts 19A and 19B about golf ball 2 and then painting golf ball 2 opaque colorant 13. The resulting golf ball has the colors 10 and 13 as shown in FIG. 5.

Figure 6:
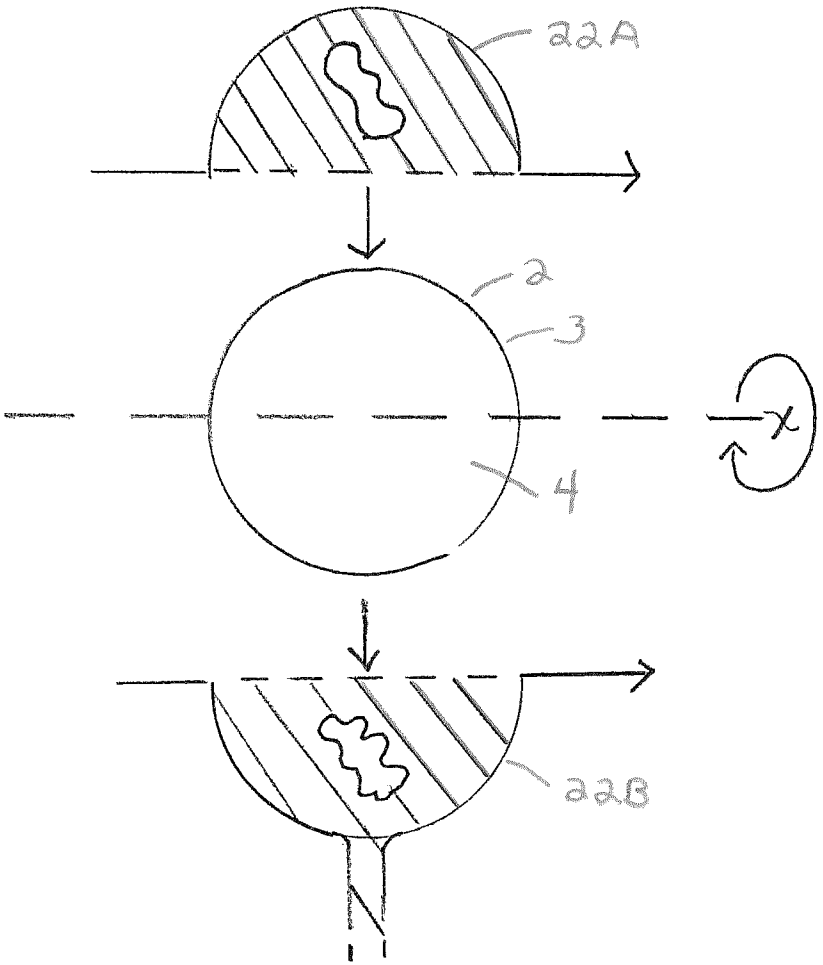
FIG. 6 is a schematic side view depicting a further aspect of the golf ball painting system and method for applying and patterning at least two different colors onto a golf ball outer surface.

FIG. 6 demonstrates a golf ball made according to the system depicted in FIG. 7 having masking parts 22A and 22B comprising at least one cut-out. While FIG. 6 shows masking parts 22 A and 22B rotating about axis x, in a different embodiment, masking parts 22 A and 22B may alternatively or additionally be rotated about outer surface 3 in a direction parallel to the x axis of FIG. 6.

Figure 8:
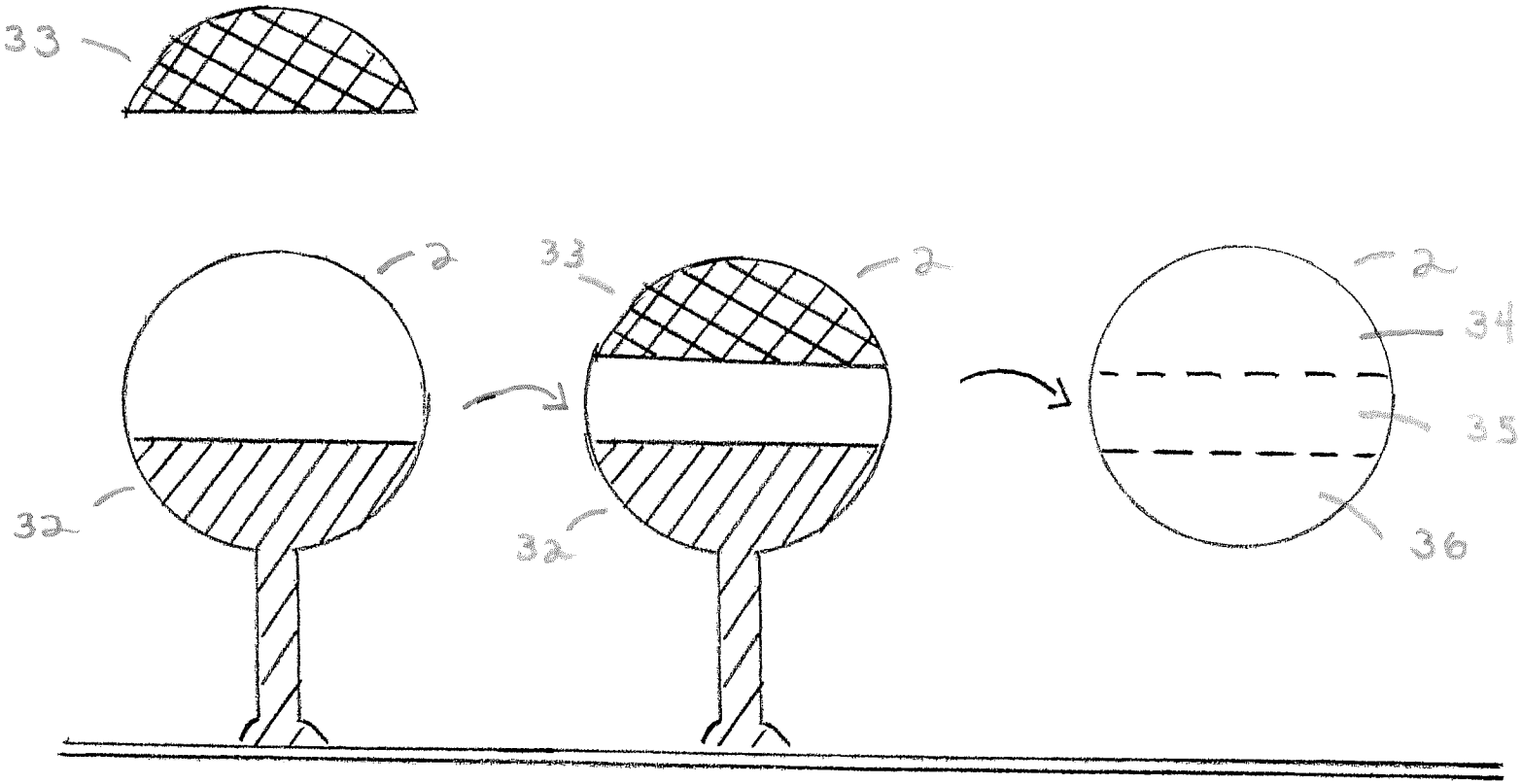
FIG. 8 is a schematic side view depicting another aspect of the golf ball painting system and method for applying and patterning at least two different colors onto a golf ball outer surface.

In FIG. 8, golf ball 2 is masked by masking parts 32 and 33, each of which masks less than half the surface area of the golf ball outer surface. Golf ball 2 is painted color 36, then masked with masking part 32, then painted color 34, then masked with masking part 33, then painted color 35. Finally, masking parts 32 and 33 are removed, producing a finished striped golf ball 2 having colors 34, 35 and 36.

Figure 9:
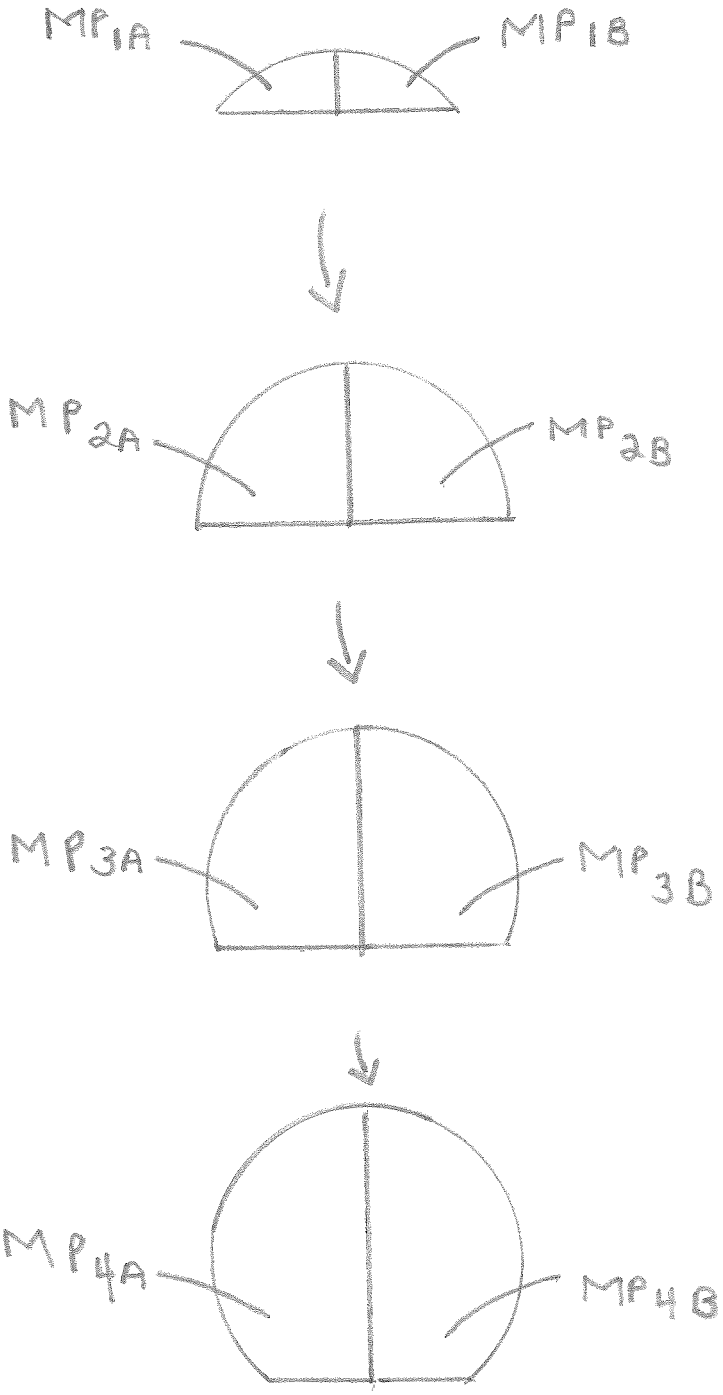
FIG. 9 is a side view depicting masking parts which may be used in the golf ball painting system and method for applying and patterning at least two different colors onto a golf ball outer surface.
Figure 10:
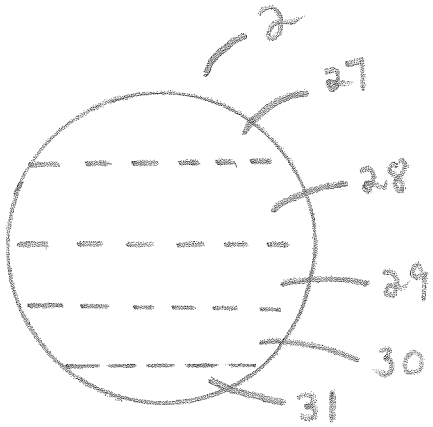
FIG. 10 is a side view depicting a golf ball resulting from utilization of the masking parts depicted in FIG. 9.

In another embodiment, as seen in FIG. 9, masking parts are applied about golf ball 2, each group of masking parts having successively larger surface areas. The groups are sequentially mated about golf ball 2, and golf ball 2 is painted coated a different color before each successive group is applied and then removed from about the golf ball outer surface. Golf ball 2 of FIG. 10 results having different colors 27, 28, 29, 30 and 31.

Synchronization and coordination of mating parts and painting may occur in a system according to the invention via processing and/or mapping means that is located either in the applicators themselves or remotely from the applicators in a separate device.

The system or method of the invention for applying and patterning at least two different paint colors onto a golf ball outer surface may be used to provide at least two colors to any golf ball known in the art and having any dimple arrangement know in the art. Herein, the term paint color means any paint or other substrate or colorant suitable for applying/providing/coating colorant onto a golf ball outer surface. The system may be used to paint/coat cores, intermediate layers and/or covers of any golf balls known in the art.

Unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Examples of such modifications include reasonable variations of the numerical values and/or materials and/or components discussed above. Hence, the numerical values stated above and claimed below specifically include those values and the values that are approximate to those stated and claimed values. Therefore, it will be understood that the appended claims are intended to cover all such modifications and embodiments, which would come within the spirit and scope of the present invention.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description.

The invention claimed is:

1. A golf ball painting system and method for applying and patterning at least two different paint colors onto a golf ball outer surface comprising:

providing at least one golf ball to be painted comprising a core and a cover disposed about the core, wherein the cover has an outer surface comprising a surface area $S_a$;

masking a portion $P_1$ of surface area $S_a$ with at least one masking part $MA_1$, portion $P_1$ having a surface area $S_b$ that is less than surface area $S_a$;

applying paint having a color $C_1$ onto an unmasked portion $P_2$ of surface area $S_a$, portion $P_2$ having a surface area $S_c$ that is less than surface area $S_a$ and such that $S_c+S_b+S_n=S_a$ wherein n is the number of masking parts;

masking surface area $S_c$ with a masking part $MA_2$;

removing $MA_1$ from $S_b$;

painting $S_b$ a color $C_2$ wherein $C_2$ is different than $C_1$; and forming a painted golf ball having an overall color appearance of at least two colors;

wherein $C_1$ is translucent.

2. The golf ball painting system and method of claim 1, wherein C2 is opaque.

3. The golf ball painting system and method of claim 1, wherein C2 is translucent.

4. The golf ball of claim 1, wherein surface area $S_b<S_c$.

5. The golf ball of claim 1, wherein surface area $S_b>S_c$.

6. The golf ball of claim 1, wherein surface area $S_b\geq 0.50\times(S_a)$.

7. The golf ball of claim 1, wherein surface area $S_b\geq 0.25\times(S_a)$.

8. The golf ball of claim 1, wherein surface area $S_b\geq 0.33\times(S_a)$.

9. The golf ball of claim 1, wherein surface area $S_b\geq 0.10\lambda(S_a)$.

10. The golf ball of claim 1, wherein surface area $S_b$ is up to about $0.10\times(S_a)$.

11. The golf ball of claim 1, wherein surface area $S_c<S_b$.

12. The golf ball of claim 1, wherein surface area $S_c>S_b$.

13. The golf ball of claim 1, wherein surface area $S_c=0.95\times(S_b)$.

14. The golf ball of claim 1, wherein surface area $S_c=0.75\times(S_b)$.

15. The golf ball of claim 1, wherein surface area $S_c=0.50\times(S_b)$.

16. The golf ball of claim 1, wherein surface area $S_c=0.25\times(S_b)$.

17. The golf ball of claim 1, wherein surface area $S_c=0.33\times(S_b)$.

18. The golf ball of claim 1, wherein masking part $MA_1$ has a surface area that is greater than surface area $S_b$.

19. The golf ball of claim 1, wherein masking part $MA_2$ has a surface area that is greater than surface area $S_c$.

20. The golf ball of claim 1, comprising masking part $MA_n$ having a surface area that is greater than $S_n$.

21. A golf ball painting system and method for applying and patterning at least two different paint colors onto a golf ball outer surface comprising:

placing a multitude golf balls to be painted on an endless conveyer, each golf ball comprising a core and a cover disposed about the core, wherein the cover has an outer surface comprising a surface area $S_a$ and having an opaque color $C_1$;

masking a portion $P_1$ of surface area $S_a$ with masking part $MP_1$, portion $P_1$ having a surface area $S_b$ that is less than surface area $S_a$;

applying paint having color $C_2$ onto the outer surface wherein $C_2$ is different than $C_1$ and forming an unmasked painted portion $P_2$ having golf ball surface area $S_c$ wherein $S_a=S_b+S_c$; and removing masking part $MP_1$ from portion $P_1$ thereby forming a painted golf ball having an overall color appearance such that:

(i) $S_b$ has the color appearance of $C_1$; and either (ii) $S_c$ has the color appearance of $C_2$ where $C_2$ is opaque; or (iii) $S_c$ has the color appearance $C_3$ where $C_2$ is translucent, wherein $C_3$ is different than $C_1$ and $C_2$.

22. A golf ball painting system and method for applying and patterning at least two different paint colors onto a golf ball outer surface comprising:

(a) placing a multitude golf balls to be painted on an endless conveyer, each golf ball comprising a core, and a cover disposed about the core, the cover having an outer surface comprising a surface area $S_a$ and being an opaque or translucent color $C_1$;

(b) masking a portion $P_1$ of surface area $S_a$ with masking part $MA_1$, portion $P_1$ having a surface area $S_b$ that is less than surface area $S_a$;

(c) applying paint having color $C_2$ onto the outer surface wherein $C_2$ is different than $C_1$ and forming an unmasked painted portion $P_2$ having golf ball surface area $S_c$ wherein $S_a=S_b+S_c$;

(d) removing masking part $MA_1$ from portion $P_1$; and (e) repeating steps (a)-(d) using different masking parts $MA_t$ and different colors $C_t$ wherein t>1 and t represents the number of times steps (a)-(d) are repeated in order to form a golf ball having an overall visual appearance of a predetermined pattern having at least two different colors.

23. A golf ball painting system and method for applying and patterning at least two different paint colors onto a golf ball outer surface comprising:

placing a multitude golf balls to be painted on an endless conveyer, each golf ball comprising a core and a cover disposed about the core, wherein the cover has an outer surface comprising a surface area $S_a$ and being pre-painted an opaque color $C_1$;

masking a portion $P_1$ of surface area $S_a$ with masking part MP, portion $P_1$ having a surface area $S_b$ that is less than surface area $S_a$;

applying paint having color $C_2$ onto the outer surface wherein $C_2$ is different than $C_1$ and forming an unmasked painted portion $P_2$ having golf ball surface area $S_c$ wherein $S_a=S_b+S_c$; and removing the masking part from about portion $P_1$ and forming a painted golf ball having an overall color appearance such that:

(i) $S_b$ has the color appearance of $C_1$; and either (ii) $S_c$ has the color appearance of $C_2$ where $C_2$ is opaque; or (iii) $S_c$ has the color appearance $C_3$ where $C_2$ is translucent, wherein $C_3$ is different than $C_1$ and $C_2$.

24. A golf ball painting system and method for applying and patterning at least two different paint colors onto a golf ball outer surface comprising:

(a) placing a multitude golf balls to be painted on an endless conveyer, each golf ball comprising a core, and a cover disposed about the core, the cover having an outer surface comprising a surface area $S_a$ and being a color $C_1$;

(b) masking a portion $P_1$ of surface area $S_a$ with masking part $MA_1$, portion $P_1$ having a surface area $S_b$ that is less than surface area $S_a$; said masking part $MA_1$ having n non-masking cut-outs that are arranged in a predetermined pattern, wherein n≥1;

(c) applying paint having color $C_2$ onto the outer surface wherein $C_2$ is different than $C_1$ and forming an unmasked painted portion $P_2$ having golf ball surface area $S_c$ wherein $S_a=S_b+S_c$;

(d) removing masking part $MA_1$ from about portion $P_1$; and (e) repeating steps (a)-(d) using different masking parts $MA_t$ and different colors $C_t$ wherein t>1 and t represents the number of times steps (a)-(d) are repeated in order to form a golf ball having an overall visual appearance of a predetermined pattern having a plurality of different colors.

* * * * *